United States Patent [19]

Altnau, Sr.

[11] Patent Number: 5,018,372

[45] Date of Patent: May 28, 1991

[54] FILTER FOR AUTOMATIC WASHING MACHINE

[75] Inventor: Ronald L. Altnau, Sr., Ripon, Wis.

[73] Assignee: Speed Queen Company, Ripon, Wis.

[21] Appl. No.: 587,827

[22] Filed: Sep. 24, 1990

[51] Int. Cl.[5] ..... D06F 13/02; D06F 39/10

[52] U.S. Cl. ..... 68/18 F; 68/53

[58] Field of Search ..... 68/18 F, 18 FA, 53; 210/167, 380.2, 391, 393, 394, 411; 134/111

[56] References Cited

U.S. PATENT DOCUMENTS

| | | | |
|---|---|---|---|
| 2,744,402 | 5/1956 | Smith | 68/18 FA X |
| 3,335,867 | 8/1967 | Perl | 210/167 |
| 3,352,130 | 11/1967 | Landwier | 68/18 F |
| 3,910,076 | 10/1975 | Roble | 68/18 F |
| 4,075,876 | 2/1978 | Platt | 68/18 F |
| 4,357,813 | 11/1982 | Sherer et al. | 68/18 F |
| 4,455,844 | 6/1984 | McMillan et al. | 68/18 F |
| 4,848,105 | 7/1989 | O'Connell et al. | 68/18 F |

FOREIGN PATENT DOCUMENTS

| | | | |
|---|---|---|---|
| 0232217 | 11/1985 | Japan | 210/411 |

*Primary Examiner*—Philip R. Coe

*Attorney, Agent, or Firm*—William R. Clark; Richard M. Sharkansky

[57] ABSTRACT

A filter for a top loading automatic washing machine wherein a substantially horizontal filter disc is positioned such that its outer periphery seats against the underside of the clothes basket bottom which is upwardly inclined towards the middle. The disc is a unitary plastic molded part, and has a large plurality of vertically aligned holes that have downward draft. An agitator provides pumping action to circulate washing fluid out of the sidewall perforations of the basket, and back into the basket through openings in the bottom thereof. The washing fluid passes through the holes of the filter disc collecting lint on the underside face. The lint is then flushed away during the spin mode of operation.

18 Claims, 4 Drawing Sheets

FILTER FOR AUTOMATIC WASHING MACHINE

BACKGROUND OF THE INVENTION

The field of the invention generally relates to automatic washing machines of the vertical axis or top loading type, and more particularly relates to a filter system for such automatic washing machines.

In the operation of an automatic home washing machine, the agitation and scrubbing of the clothes for removing soil also removes particles of lint and other foreign material from the fabrics. These lint and foreign particles become suspended in the washing fluid and, unless they are removed or filtered therefrom, they may attach to or become deposited back on the clothes being laundered. Accordingly, various types of filters or lint traps have been used in the prior art to remove the lint from the washing fluid.

Many of the prior art filter arrangements include a lint filter centrally positioned within the fabric container or clothes basket such as inside the agitator. These devices ordinarily occupy considerable space within the clothes basket, and reduce the effective access opening into the basket. In addition, a filter of this type normally requires frequent manual cleaning to maintain its effectiveness.

Another prior art approach to lint filtering includes an external recirculating system for removing the washing fluid from the tub and passing it through a filter screen. This type of system, however, includes additional costs for an auxiliary pump, the washing fluid conduits, and the labor to install them.

U.S. Pat. No. 3,352,130 discloses a filtering arrangement in an automatic washing machine wherein the washing fluid is pumped from the outer tub into the clothes basket by the pumping action of the agitator oscillating within the clothes basket during the washing cycle. The washing fluid enters the basket from the tub through openings in the bottom of the basket, and the washing fluid recirculates out through perforations in the sidewall of the basket and down between a space between the tub and the basket. Filter screens are mounted in the openings in the bottom of the basket to collect the lint carried by the washing fluid passing through the openings. The collected lint is then intended to be flushed away during the spin cycle and carried away to the drain. However, the use of a filter screen has a disadvantage in that the ends of fibers may tend to protrude through or become caught on the screen such that the collected fibers are not dislodged by the centrifugal force of the spin mode. Thus, without complete cleaning or flushing during the spin mode, the fibers build on the screen and reduce the recirculation flow rate of washing fluid and the effectiveness of the filter. Eventually, the screen filter may become completely plugged thus eliminating all lint filtering. Also, there is a disadvantage in positioning the filter screens within openings in the clothes basket bottom. Specifically, in order to have enough filter surface area to obtain an acceptable washing fluid flow rate through the filter screens, the openings must be relatively large thus reducing the structural integrity or rigidity the clothes basket. Stated differently, if the structural integrity of the clothes basket is maintained by having relatively small openings for the filter screens, the fluid flow rate may be too small to provide effective filtering.

One solution to this problem is to increase the thickness of the basket bottom, but that involves additional costs.

U.S. Pat. No. 4,357,813 discloses another automatic washer filter arrangement wherein the washing fluid is pumped up through openings in the clothes basket bottom by the agitator. Positioned below the clothes basket is a truncated filter cone that has teeth extending upwardly and outwardly from the lower end periphery of the cone. As the pumping agitator draws washing fluid along a path radially inward from the periphery of the tub sump beneath the basket, lint carried by the washing fluid is trapped on and between the teeth of the filter cone. This filter arrangement, however, is relatively inefficient at removing lint as a large percentage of the lint passes between the teeth. Also, lint may tend to be caught on the teeth such that the lint is not washed away during the spin cycle.

SUMMARY OF THE INVENTION

It is an object of the invention to provide an improved filtering system for a top loading automatic clothes washing machine.

It is a further object to provide a lint filtering system that is cost effective to manufacture and assemble, yet effectively filters lint from the washing fluid.

It is a further object to provide a lint filtering system that provides a relatively high circulation flow rate of the washing fluid through the filter, but does not require increasing structural rigidity of the basket bottom so as to permit large openings in the bottom.

Another object is to provide a lint filter with a relatively large surface area or face such that a desired size of filter holes can be used without restricting the recirculation flow rate of the washing fluid.

It is a further object to provide a lint filter that is effectively cleaned during the spin mode.

Another object is to provide a lint filter that does not collect lint on the top side during the drain down of the tub.

These and other objects and advantages are provided by a washing machine comprising a vertical tub adapted for holding a washing fluid, a clothes basket positioned in the tub wherein the basket has a cylindrical sidewall with a plurality of perforations and a bottom with at least one opening, the sidewall and the bottom being spaced from the tub to provide a vertical passageway outside the basket at the side and a region in the tub underneath the basket, the bottom being upwardly inclined toward the center. An agitator comprises means for circulating the washing fluid out of the basket through the perforations in the sidewall and down the vertical passageway to the region underneath the basket from where the washing fluid passes back up into the basket through the opening in the bottom. A lint filter is positioned in the region underneath the basket for filtering lint from the circulating washing fluid, and the filter comprises a substantially horizontal disc having an outer periphery seated against the underside of the basket bottom wherein a chamber is formed between the disc and the upwardly inclined bottom. The disc has an underside face with a plurality of holes communicating with the chamber wherein the washing fluid is circulated up through the holes. The holes are of such a size as to filter lint from the washing fluid, which lint collects on the underside face of the disc. It is preferable that the lint filter further includes an upwardly directed cylindrical wall connected to the disc and an inwardly directed flange connected to the cylindrical wall. The flange may be seated against the basket bottom and sandwiched between the basket and the hub of the basket. It is preferable that the lint filter be constructed as a unitary plastic molded part. The holes may number more than 3,000 such as, for example, 3,888, and preferably the holes have a downward draft such as, for example, 15°, that tapers outwardly. The depth of the holes through the disc may preferably be approximately 0.06". Also, the disc may have a plurality of radial ribs to provide structural integrity. Further, at least one peripheral channel may be provided in the disc. The holes in the disc may be either substantially rectangular or circular, and have at least one dimension in the range from 0.020" to 0.060".

With such arrangement, lint is effectively collected on the relatively large underside face area of the lint filter. The holes are small enough so that lint fibers tend not to pass therethrough or to pass partially therethrough eventually leading to plugging of the filter. Conversely, the holes are large enough in number and size so as not to unduly restrict the flow rate of recirculating washing fluid. The downward draft of the holes facilitates ease of manufacture by molding, and also helps to remove collected lint fibers by eliminating sharp hole edges on the underside of the disc where the lint collects. Further, the peripheral channel provides a passageway for a small amount of lint to be flushed from the top side of the disc by centrifugal force after draindown.

BRIEF DESCRIPTION OF THE DRAWINGS

The foregoing objects and advantages will be more fully understood by reading the following description of the preferred embodiment with reference to the drawings wherein.

DESCRIPTION OF THE PREFERRED EMBODIMENTS

Figure 1:
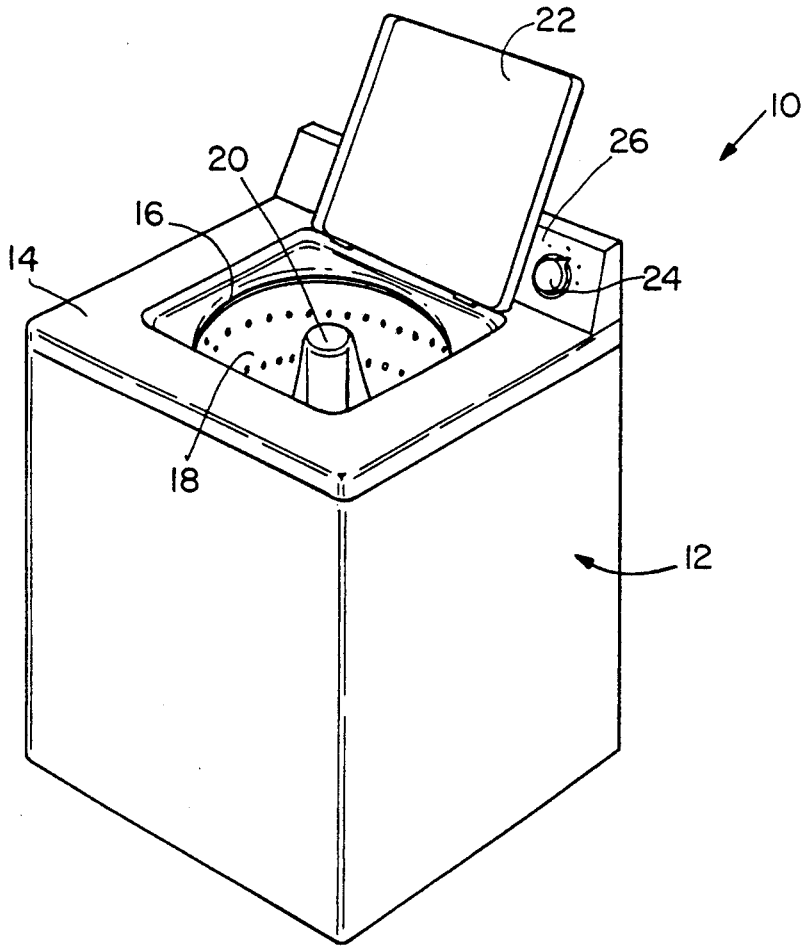
FIG. 1 is a perspective view of a top loading automatic clothes washing machine.

FIG. 1 shows a top loading or vertical axis automatic home washing machine 10 which has a cabinet 12 having a top panel 14 with an access opening 16 for loading and retrieving clothes from clothes basket 18 or spin tub. An agitator 20 is positioned within clothes basket 18. In conventional manner, the clothes to be washed are loaded through access opening 16 into clothes basket 18 and, after the lid 22 is closed and the controls 24 on control panel 26 are set, washing machine 10 sequences through a plurality of cycles. For example, such cycles typically include wash, rinse and spin cycles. During the wash and, rinse cycles, agitator 20 is driven back and forth in conventional manner through a predetermined arc to agitate or scrub the clothes so as to remove soil. Typically, agitator 20 may be driven at approximately 60 strokes per minute with a stroke arc of approximately 210°. During this action, lint and other foreign particles are also separated from the fabric of the clothes, and such particles become suspended in the washing fluid. During the spin cycle, the washing fluid is drained from the tub 28 (FIG. 2), and the clothes basket 18 is rotated about its vertical axis at a relatively high speed to extract moisture from the clothes by centrifugal force.

Figure 2:
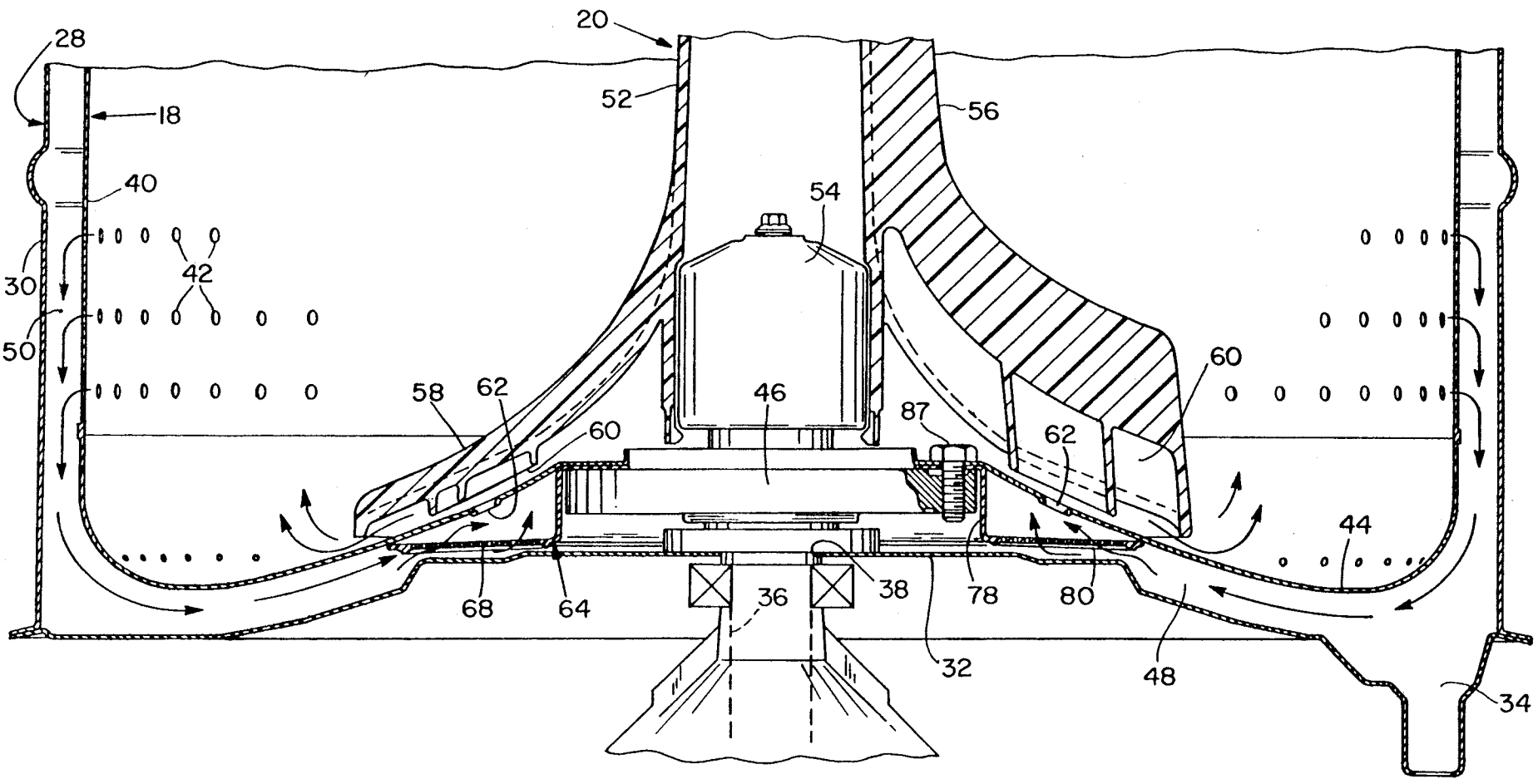
FIG. 2 is a side sectioned view showing the tub, clothes basket, agitator, and lint tray.

FIG. 2 shows a cross-sectional view of the clothes basket 18 mounted concentrically within vertically oriented outer tub 28. In conventional manner, outer tub 28 is imperforate for holding washing fluid, and includes sidewall 30, bottom 32, and drain 34. In conventional manner, a drive shaft 36 extends up through an aperture 38 in tub bottom 32, and provides alternating drive for agitator 20 in the agitate mode, and high speed drive for clothes basket 18 and agitator 20 in the spin mode.

Clothes basket 18 has a generally cylindrical sidewall 40 having a plurality of perforations 42. The bottom 44 of clothes basket 18 is generally inclined upwardly towards the central axis, and is connected to mounting hub 46 which couples the spin drive from drive shaft 36. Clothes basket 18 is spaced from outer tub 28, thus defining a region 48 in the sump portion of tub 28 underneath clothes basket 18, and a vertical passageway 50 around sidewall 40.

Agitator 20 has a central post 52 which is coupled to hub 54 to provide the back and forth or oscillating drive for agitator 20. Agitator 20 has a plurality of suitable vanes 56 extending radially from central post 52 so as to agitate the washing fluid as agitator 20 is driven back and forth during the wash and rinse cycles. A skirt portion 58 of agitator 20 includes underside vanes 60 that provide a pumping action for the washing fluid in the radially outward direction. More specifically, in conventional manner, underside vanes 60 could have any one of a wide variety of shapes or contours such that, as agitator 20 is rotated during agitation, washing fluid from underneath skirt portion 58 is directed radially outward by centrifugal force thereby creating a low pressure region underneath skirt portion 58. Bottom 44 of clothes basket 18 has a plurality of openings 62, and washing fluid is drawn from region 48 of tub 28 up through openings 62 into clothes basket 18. This washing fluid, in turn, is then forced radially outward by the pumping action of underside vanes 60, and a circulating path is provided out through perforations 42 and down vertical passageway 50. In short, conventional apparatus is provided to create a pumping action whereby the washing fluid is pumped in a circulation path as shown by the arrows. That is, the washing fluid is pumped outwardly from underneath the skirt portion 58 of agitator 20, out through perforations 42 and downwardly in vertical passageway 50, and then radially inwardly underneath clothes basket 18 and up through openings 62 back into clothes basket 18. Here, there are eight openings 62 of approximately 0.437" diameter arranged in a circle around bottom 44.

Figure 3:
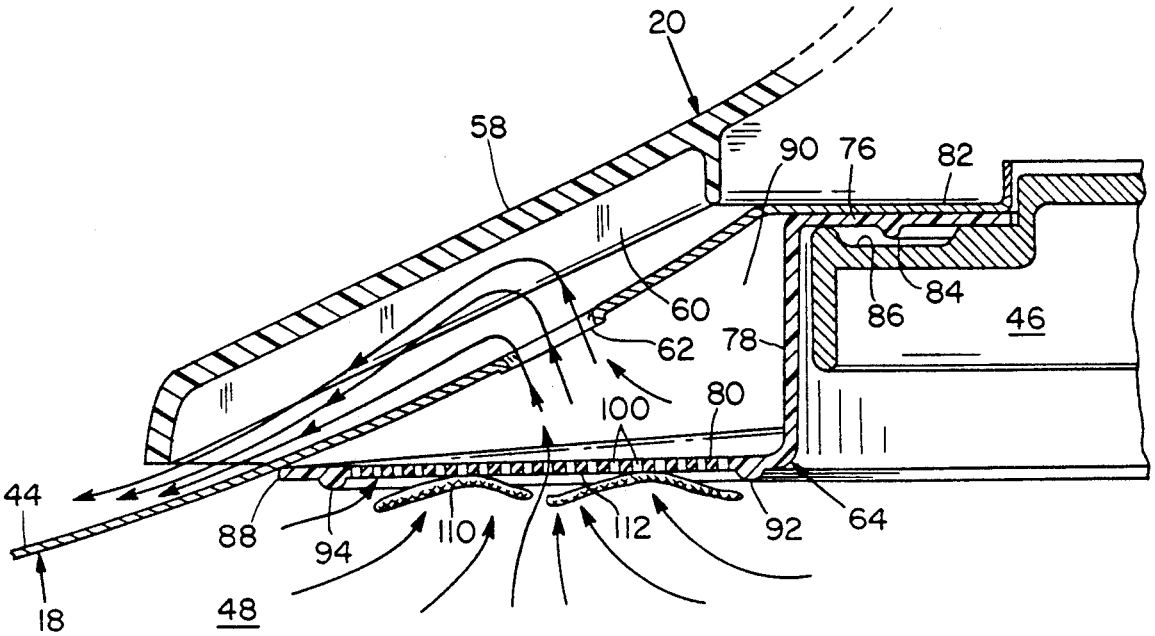
FIG. 3 is an expanded side sectioned view of the lint tray mounted to the clothes basket during the agitation mode.
Figure 4:
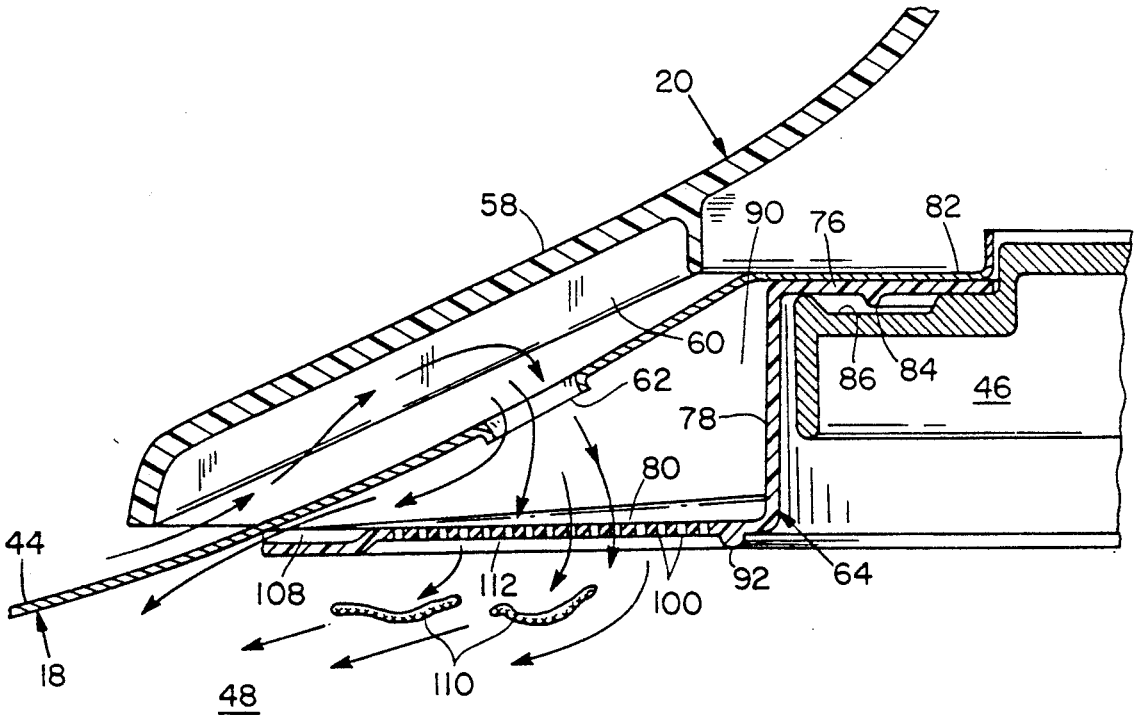
FIG. 4 is a side sectioned view similar to FIG. 3 taken through a channel of the lint tray during the spin mode.
Figure 5:
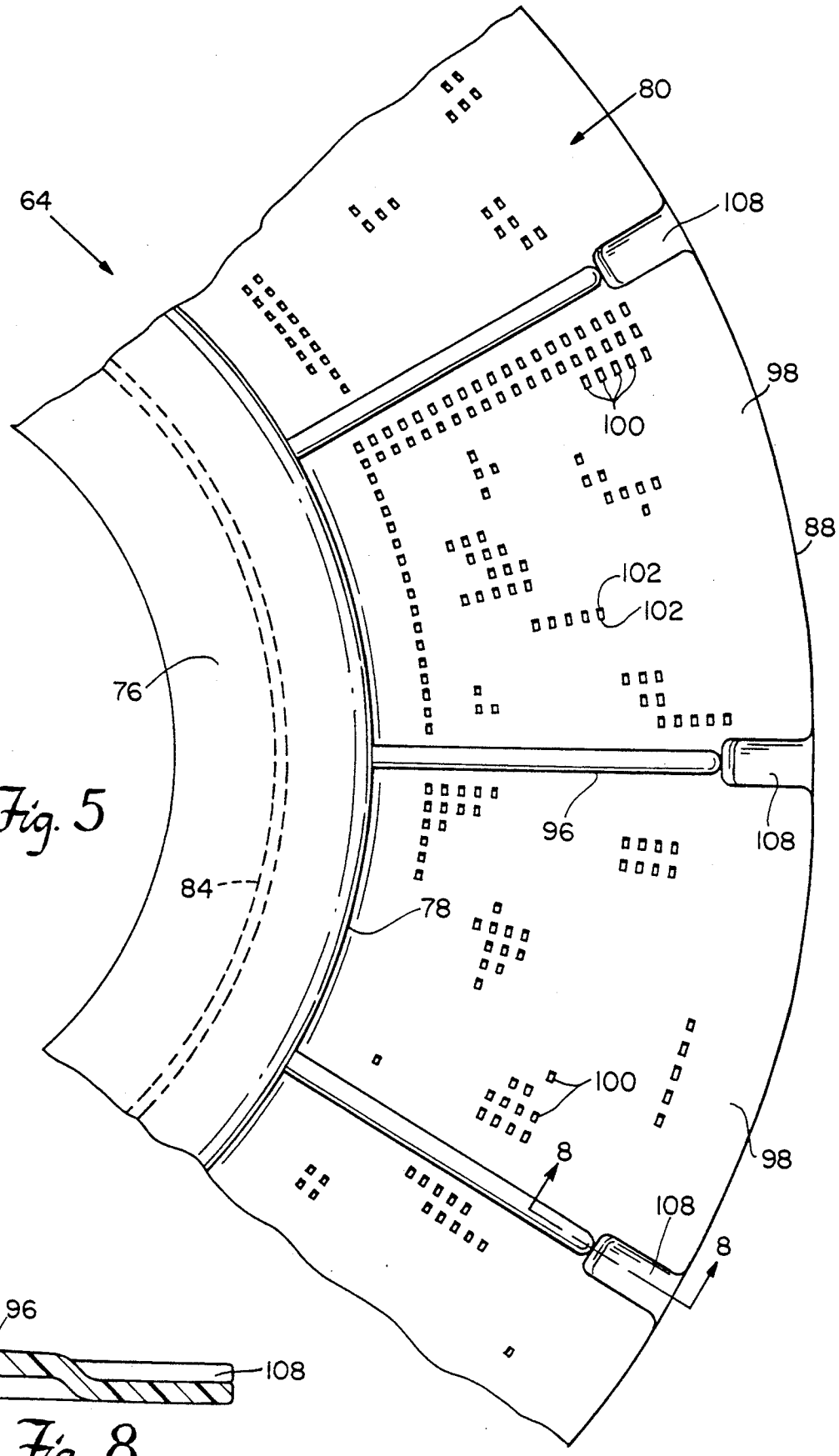
FIG. 5 is a top view of the lint tray.

Referring also to FIGS. 3–5, filter tray 64 here is a unitary plastic molded part such as a talc filled polypropylene, and includes an upper annular flange 76 or plate having a downwardly extending cylindrical wall 78 connected to the outer perimeter thereof, and an outwardly extending substantially horizontal annular disc 80 or plate connected to the bottom of wall 78. Flange 76 functions to mount filter tray 64, and is sandwiched between an inner flange 82 of clothes basket 18 and mounting hub 46. Flange 76 has an annular rib 84 or dimples that nest in a corresponding recess 86 of mounting hub 46 so as to accurately locate filter tray 64 with respect to hub 46. As shown in FIG. 2, circumferentially mounted bolts 87 or screws are used to secure basket 18, filter tray 64, and hub 46. As shown best in FIGS. 3 and 4, cylindrical wall 78 extends downwardly adjacent the lateral exterior of mounting hub 46. Annular disc 80, which connects to the bottom of cylindrical wall 78 extends substantially horizontally and has a perimeter portion 88 or periphery that seats against the underside of the bottom 44 of clothes basket 18. In an unbiased state, disc 80 is slightly conical being upwardly inclined in the outward direction. However, as basket 18 is brought against resilient filter tray 64 during assembly, bottom 44 pushes against and deflects disc 80 to a substantially horizontal orientation. With such arrangement, outer perimeter portion 88 of disc 80 is flexed tightly upwardly against bottom 44 thus providing a substantial seal between filter tray 64 and basket 18. The inner portion of filter tray 64 is also sealed to basket 18 as inner flange 82 is pressed against flange 76. As bottom 44 of clothes basket 18 inclines upwardly towards the vertical axis of clothes basket 18, an annular chamber 90 of substantially triangular cross section is formed between bottom 44 and filter tray 64.

Disc 80 functions as the filter portion of filter tray 64. As shown in FIG. 3, annular disc 80 or plate has underside ring ribs 92 and 94 to provide structural rigidity. As shown generally in FIG. 5, annular disc 80 also has a plurality, such as twelve, upper side radial ribs 96 that provides structural rigidity, and also segregate disc 80 into twelve truncated sectors 98 in which filter holes 100 are provided. In a preferred embodiment, each sector 98 has eighteen radially aligned rows of holes 100 with eighteen holes 100 in each row. Due to advantages in machining the dye to mold filter tray 64, it may be desirable that opposing sides 102 of each hole be cut along radial lines. In such manner, the holes 100 adjacent the outer perimeter are wider than holes 100 adjacent the inner perimeter. For example, holes 100 closest to the center may have a width of 0.039", and most outward holes may have a width of 0.057". The intermediate holes 100 would gradually get wider in the outward direction. Here, each hole 100 has a radial dimension of 0.025", and the radial spacing between holes is 0.065".

Figure 6:
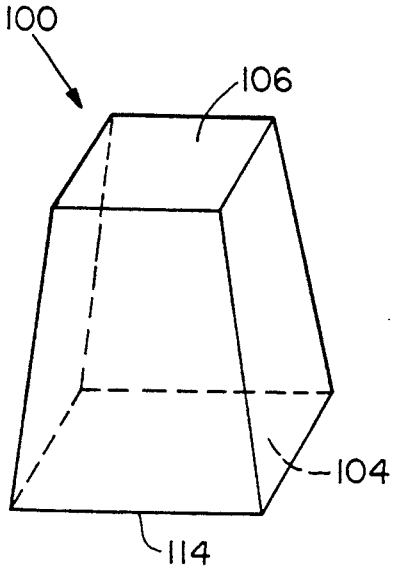
FIG. 6 depicts the geometry of a lint filter hole.

Referring to FIG. 6, the general shape of a hole 100 is shown. It is desirable that holes 100 have a draft so that filter tray 64 may readily be separated from the machined dye, and, as will be described later herein, it has been found desirable that each hole 100 have a draft of approximately 15° in both radial and circumferential directions, with the underside entrance 104 being larger than the top side exit 106. The preferred thickness of disc 80 in the sectors 98 where holes 100 are located is approximately 0.06". Thus, holes 100 here have a depth of 0.06".

Figure 7:
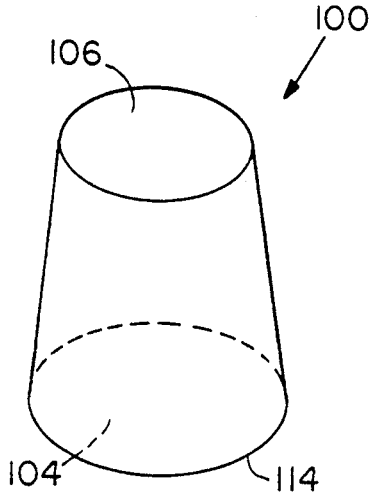
FIG. 7 is an alternate embodiment of a lint filter hole.

FIG. 7 shows an alternate shape for holes 100. Here, holes 100 are circular with a downwardly flared draft, and the hole 100 has substantially the same size as the hole 100 shown in FIG. 6.

Figure 8:
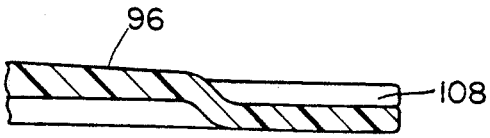
FIG. 8 is a view taken along line 8—8 of FIG. 5.

Channels 108 or recesses are provided between the outer perimeter 88 of disc 80 and the extremity of ribs 96 as shown best in FIG. 5. FIG. 8 is a side sectioned view taken along line 8—8 of FIG. 5, and shows that although the major portion of the perimeter 88 or periphery of disc 80 is sealed against the underside of bottom 44, passage channels 108 are provided at twelve locations around the outer perimeter 88 or circumference of disc 80, and the channels 108 may preferably have a depth of 0.06" and a width of approximately 0.44".

As described earlier, underside vanes 60 of agitator 20 force washing fluid centrifugally outward while agitating in the wash or rinse cycles. This pumping action creates a low pressure underneath skirt portion 58 which draws washing fluid upwardly through openings 62, and the washing fluid recirculates out through perforations 42 and then down vertical passageway 50 to be drawn radially inwardly. This circulating washing fluid passes vertically upwardly through the holes 100 in filter tray 64. As the perimeter 88 of filter tray 64 is substantially sealed around the outer circumference of disc 80 with the exception of channels 108, substantially all of the circulating washing fluid passes through holes 100. As shown in FIG. 3, the lint 110 that is suspended in the washing fluid is collected on the underside face portion 112 of disc 80 in the wash and rinse cycles. Because disc is substantially horizontal, the surface area of the filter portion (i.e. portion with holes 100) of disc 80 is relatively large. For example, the filter portion of disc 80 may have an outer radius of approximately 5.5" and an inner radius of approximately 3.5", thereby providing a filter area of approximately 56 square inches for locating holes 100. As a result of this relatively large surface area, a large plurality of relatively small holes 100 are disposed in the filter portion thereby enabling effective filtering while still maintaining a relatively high recirculation flow rate. In other words, an efficient balance between flow rate and hole size has been provided. If the filter portion were substantially smaller such that holes 100 had to be larger to provide a sufficient circulation flow rate, lint could be drawn through the larger holes 100.

After an agitate cycle as shown in FIG. 3, washing machine 10 typically commences a spin cycle wherein the washing fluid is drained from tub 28 through drain 34. The draining washing fluid exits clothes basket 18 through perforations 42 and also through openings 62. This drain down of washing fluid through openings 62 as shown by the arrows in FIG. 4 carries away the lint 110 and other foreign particles from the underside face 112 of disc 80. Such flow in response to draining of washing fluid and also the spinning of clothes basket 18 automatically flushes the face 112 of filter portion for the next washing operation. It has been found that with the substantially horizontal arrangement of filter portion or face 112 and the generally upward flow of washing fluid through filter portion, the filter surface area can be made large enough to provide a large plurality such as, for example, 3888 holes 100, and therefore, a sufficient flow rate can be provided with relatively small holes 100 that effectively filter the lint. If holes 100 were larger, lint 100 could pass therethrough and also lint 100 could become caught in holes 100 thus plugging them. If holes 100 were too small, the filtering would not be effective because the circulation flow rate would be too low. Further, the lint 100 that collects on the face 112 of the filter portion is effectively flushed or washed away during a spin cycle so that there is cleaning of the filter tray 64. More specifically, due to the downward draft of holes 100 as described with respect to FIGS. 6 and 7, lint 110 or fibers that have ends inserted into the holes 100 tend to be washed away easily as shown in FIG. 4 because the fibers tend not to be caught on the edge 114 between the holes 100 and the face 112; the draft causes the edge 114 to be less sharp. As a result, fibers 110 do not tend to become caught on the holes 100, and filter tray 64 is effectively cleaned during draining and/or spinning of clothes basket 18. If the draft were in the opposite direction (i.e. upward draft), the centrifugal force of the spin cycle could tend to cause lint with ends inserted into holes 100 to cling to rather than release from the lower edges 114 of the holes 100; the angle would be sharper. Also, lint 110 may tend to be dislodged better from circular hole 100 as shown in FIG. 7 because there are no corners to catch the fibers.

The outer edge or perimeter 88 of disc 80 has a different section line in FIG. 4 than in FIG. 3, thus showing a channel 108 leading from chamber 90 down into region 48. Channels 108 provide a small passageway or exit for any lint 110 that may have collected on the top side of disc 80 as the washing fluid drains down. The centrifugal force of the spin cycle causes lint 110 on the top side of filter portion to be forced outwardly to exit through clean out channels 108. As described heretofore, channels 108 are relatively narrow so as not to interfere with the inner perimeter of flange 76 and outer periphery 88 of filter tray 64 being substantially sealed to the clothes basket 18 so that most of the circulating wash fluid passes through holes 100.

This concludes the description of the preferred embodiments. A reading of it by those skilled in the art will bring to mind many modifications and alterations without departing from the spirit and scope of the invention. Accordingly, it is intended that the invention be limited only by the appended claims.

What is claimed is:

1. A washing machine comprising:

a vertical tub adapted for holding a washing fluid;

a clothes basket positioned in said tub, said basket having a cylindrical sidewall with a plurality of perforations and a bottom with at least one opening, said sidewall and said bottom being spaced from said tub thereby providing a vertical passageway in said tub outside said basket and a region in said tub underneath said basket, said bottom being upwardly inclined toward the center;

an agitator comprising means for circulating said washing fluid out of said basket through said perforations in said sidewall, down said vertical passageway to said region underneath said basket, and up into said basket through said at least one opening; and a lint filter positioned in said region underneath said basket for filtering lint from said circulating washing fluid, said filter comprising a substantially horizontal disc having an outer periphery seated against the underside of said basket bottom wherein a chamber is formed between said disc and said upwardly inclined bottom, said disc having an underside face with a plurality of holes communicating with said chamber for passing said circulating washing fluid, said holes being of such a size as to filter from said circulating washing fluid lint which collects on the underside face of said disc, said holes having downward draft wherein the bottom openings to said holes are larger than the respective top openings.

2. The washing machine recited in claim 1 wherein said lint filter further comprises an upwardly directed cylindrical wall connected to said disc and an inwardly directed flange connected to said cylindrical wall, said flange being seated against said basket bottom.

3. The washing machine recited in claim 2 wherein said lint filter is a unitary plastic molded part.

4. The washing machine recited in claim 2 further comprising a hub for spinning said clothes basket, said flange being sandwiched between said hub and said basket.

5. The washing machine recited in claim 1 wherein said disc has more than 3000 of said holes.

6. The washing machine recited in claim 1 wherein said holes in said disc have a depth of approximately 0.06".

7. The washing machine recited in claim 1 wherein said disc comprises a plurality of radial ribs providing structural rigidity.

8. The washing machine recited in claim 7 wherein twelve of said radial ribs divide said disc into twelve sectors each with approximately 18 rows of 18 holes.

9. The washing machine recited in claim 1 wherein said outer periphery of said disc has at least one channel wherein a portion of said outer periphery is spaced from said underside of said basket bottom to provide a passageway from said chamber to said region.

10. The washing machine recited in claim 1 wherein said holes have at least one dimension in the range from 0.020" to 0.060".

11. The washing machine recited in claim 1 wherein said holes are rectangular.

12. The washing machine recited in claim 1 wherein said holes are circular.

13. A washing machine comprising:

a vertically oriented outer tub adapted for holding a washing fluid, said tub having a drain;

a clothes basket having a cylindrical sidewall with perforations and a bottom upwardly inclined towards the center, said bottom having at least one opening, said basket being positioned in said tub and spaced therefrom thereby defining a region underneath said basket and a vertical passageway adjacent said sidewall;

an agitator positioned in said basket;

means for agitating said agitator back and forth in an agitation mode of operation and for rotating said agitator and basket in a spin mode of operation;

said agitator comprising a skirt and means for pumping washing fluid from under said skirt in said agitation mode wherein washing fluid is circulated out through said perforations, down said vertical passageway, radially inwardly into said region and upwardly through said at least one opening back into said basket under said skirt; and a unitary plastic molded lint filter positioned in said region under said basket for filtering lint from said circulating washing fluid, said filter comprising an upper annular flange seated against the underside of said basket, a downwardly extending wall connected to said flange and an outwardly directed substantially horizontal annular disc having an inner periphery connected to said filter wall and an outer periphery seated against the underside of said basket bottom, said disc having a bottom face with a plurality of through holes of such size for passing said circulating washing fluid vertically upwardly while filtering lint therefrom, said lint being collected on said face during said agitation mode and being carried away when said washing fluid is drained from said tub and said basket is rotated in said spin mode of operation, said disc having at least one outer edge channel wherein a portion of said outer periphery of said disc is spaced from said underside of said basket to provide a passageway for any lint on top of said disc to exit during said spin mode of operation.

14. The washing machine recited in claim 13 wherein said holes have a downward draft.

15. The washing machine recited in claim 14 wherein said draft is approximately 15° .

16. The washing machine recited in claim 13 wherein said disc has more than 3000 of said holes.

17. The washing machine recited in claim 13 wherein said holes in said disc have a depth of approximately 0.06".

18. The washing machine recited in claim 13 wherein said holes are arranged in a plurality of radial rows.

* * * * *